United States Patent [19]

Reninger

[11] 4,261,695

[45] Apr. 14, 1981

[54] CANDLE LAMP

[76] Inventor: James D. Reninger, 215 Fiesole St., Venice, Fla. 33595

[21] Appl. No.: 38,472

[22] Filed: May 14, 1979

[51] Int. Cl.[3] ..... F23D 3/24

[52] U.S. Cl. ..... 431/320; 431/313

[58] Field of Search ..... 431/302, 303, 312, 313, 431/320

[56] References Cited

U.S. PATENT DOCUMENTS

| | | | |
|---|---|---|---|
| 95,460 | 10/1869 | Gilman | 431/312 |
| 545,313 | 8/1895 | Robertson | 431/320 |
| 2,503,496 | 4/1950 | Kwasniewski | 431/320 |
| 2,784,581 | 3/1957 | Quandt | 431/321 |
| 3,799,731 | 3/1974 | Novak | 431/313 |
| 3,994,672 | 11/1976 | Novak | 431/320 |
| 4,134,718 | 1/1979 | Kayfetz et al. | 431/320 |

*Primary Examiner*—Joseph Man-Fu Moy
*Attorney, Agent, or Firm*—Hauke and Patalidis

[57] ABSTRACT

A candle lamp comprises a reservoir base in which there is a quantity of combustible fuel. A cover over the base supports a structure on which is mounted coaxially with a passage through the structure two spaced apart concentric tubular members. The outer tubular member is formed as an ordinary wax candle or in other desireable shape. The inner tubular member supports at its upper end an adapter. Through the adapter passes a wick that extends into the reservoir base. The wick forms with the wall of the bore through the adapter at least one axial channel.

A decorative chimney of translucent substance is supported on the top of the reservoir and surrounds the concentric tubular members.

1 Claim, 2 Drawing Figures

CANDLE LAMP

BACKGROUND OF THE INVENTION

The present invention relates generally to replaceable combustible fluid-burning assemblies for use on tables in restaurants, lounges and the like.

For many years restaurants and lounges and the like have used various forms of candles, oil lamps and bulbous receptacles holding liquid wax with a wick floating thereon. Other forms of lamps for tables include a reservoir holding combustible fluid in which one end of a form of wick is immersed. The other end of the wick is held in a convenient structure above the reservoir and is surrounded by a glass chimney of decorative design.

Few if any of the table lamps known from the prior art appear to be candles; such lamps have the appearance of ordinary oil lamps.

In contrast to the table lamps known from the prior art, the candle lamp of the present invention comprises a combustible fuel-burning assembly that resembles very closely a common wax candle, but which obviates the disadvantages of a burning wax candle or a receptacle of hot wax with a burning wick floating in it.

SUMMARY OF THE INVENTION

A candle lamp in accordance with the invention comprises a reservoir base in which a combustible fluid is stored; a support structure mounted on the top of the base; concentrically arranged and radially spaced apart tubular members mounted on the support structure in such a manner that both of the tubular members are axially disposed with a passage in the support structure that communicates with the combustible fluid in the reservoir base.

In the upper end portion of the inner concentrically arranged tubular member resides an adapter having an axial bore or passage through it. The adapter is fitted in the tubular member in such a way that the top end portion of the outer tubular member, shaped like a wax candle or other desired shape, is just below the top of the adapter, thereby eliminating burning and discoloration of the outer tubular member.

A wick is inserted through the axial bore in such a way that at least one vaporizing passage is formed by the wick and the wall of the axial bore and communicates with the fluid in the reservoir base.

Surrounding the tubular assembly and supported on the top of the reservoir base is a translucent chimney of glass or other suitable substance, having the color and shape to suit one's preference or decor.

For a further understanding of the invention and for features and advantages thereof, reference may be made to the following description and drawing illustrating one embodiment of the invention.

DETAILED DESCRIPTION

Figure 1:
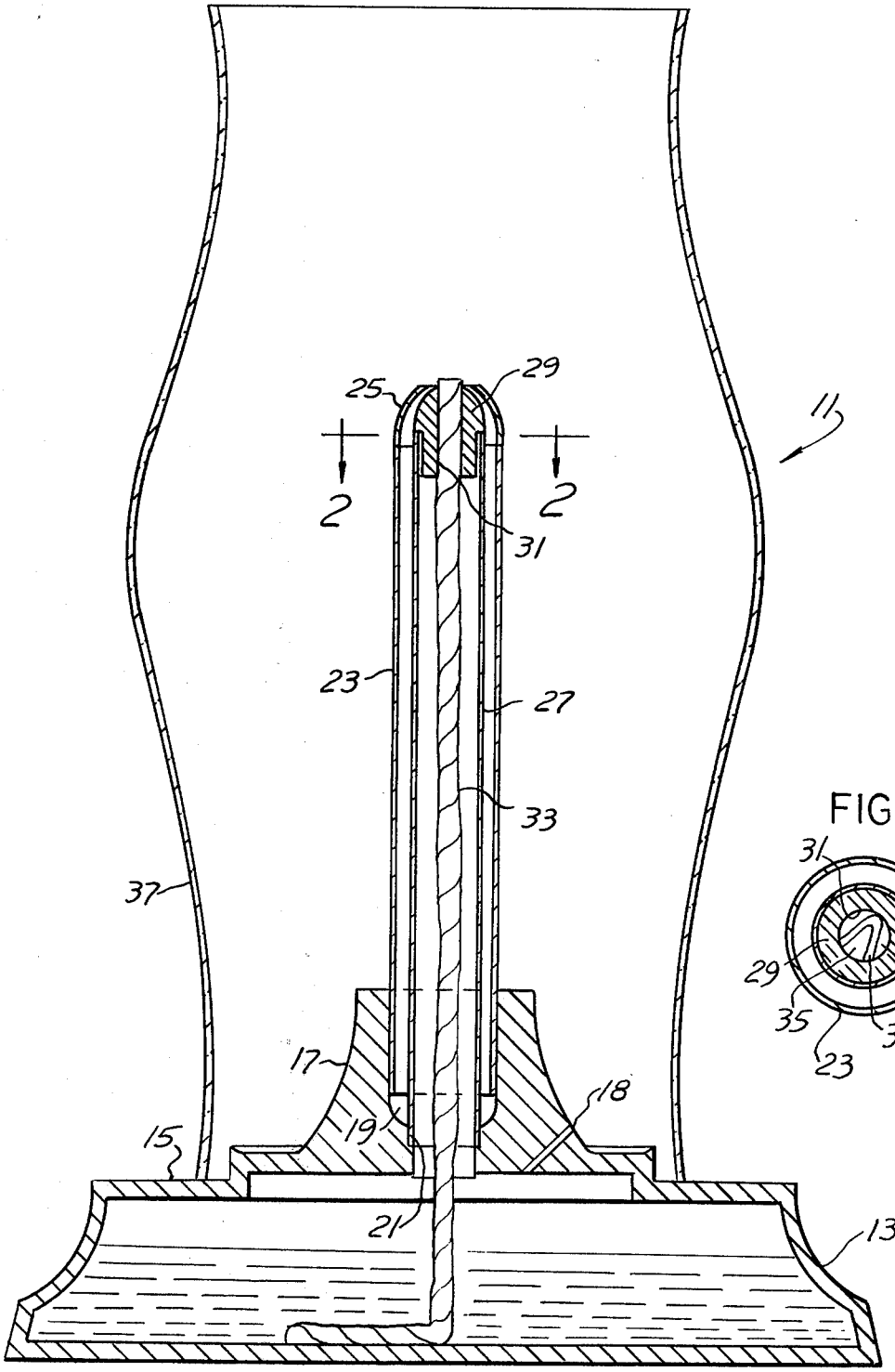
FIG. 1 is a vertical sectional view of a candle lamp in accordance with one embodiment of the invention.

Referring to FIG. 1, a candle lamp 11 in accordance with the invention comprises a hollow reservoir base 13 in which there is a quantity of combustible fuel and which has a horizontal top surface 15 above which rises a formed frusto-conical structure 17. As shown in FIG. 1, an air vent 18 is provided in the frusto-conical structure 17 that allows atmospheric air to pressurize the interior of the reservoir base 13. Such an air vent facilitates filling the reservoir with fuel and assists capillary action in the wick 33 (mentioned hereinafter).

The formed frusto-conical structure 17 has a central opening 19 with reentrant bore 21 of lesser diameter than the opening 19. Removably positioned in the central opening 19 is a tall thin tubular sleeve 23 having a top 25 shaped like a conventional wax candle. Positioned in the reentrant bore 21 is an elongate thin tubular member 27 that terminates just below the top of the tubular sleeve 23. The two tubular members 23, 27 are preferably concentrically arranged.

Inserted into the top of the tubular member 27 is a removable adapter 29 having a vertical cross sectional shape about as shown in FIG. 1. The adapter 29 has an axial bore 31 through it in which a wick 33 is placed; the wick 33 extending upwardly from the combustible fuel in the reservoir base 13 to slightly above the top of the adapter 29.

Figure 2:
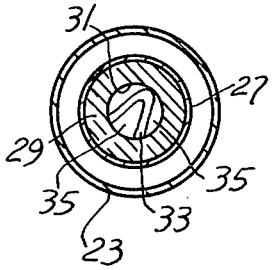
FIG. 2 is a view along line II—II of FIG. 1, but at an enlarged scale.

As shown in FIG. 2, the adapter 29 slides easily into the tubular member 27. However, those skilled in the art will know that the adapter may be threaded into or onto the tubular member 27, if such construction is preferred.

In one aspect of the invention, the wick 33, being flat and folded as shown in FIG. 2, forms with the inner wall of the axial bore 31, at least one and preferably three vertical channels 35 through the adapter 29 that serve as fuel-vaporizing channels.

The present invention, however, contemplates that the wick 33 may have any suitable cross sectional shape as long as at least one vertical fuel-vaporizing channel 35 is formed by the wall of the axial bore 31 and the wick 33 itself.

It is thought that ambient air, heated as it passes down close to the flame at the burning wick 33, flows downward in one or more of the vertical fuel-vaporizing channels 35 and thereby vaporizes the combustible fuel in the wick 33 just below the top of it.

Thus, it is mostly vaporized fuel that burns once the candle lamp is lighted and not the wick itself. In practice, then, a candle lamp in accordance with the invention, having a wick as described herein, will last for a long period of time under conditions of use such as on tables in restaurants, lounges and the like.

Adjustment of the wick is easily accomplished. One merely grasps the adapter, raises it and urges the wick upward toward the shaped top. Then the adapter is replaced in the tubular member as it was originally.

While in some instances the candle lamp may be constructed without more than has been described herein, in other instances a glass or other translucent chimney 37 may be found useful if only for decorative purposes. One form of chimney 37 is shown in FIG. 1, but those skilled in the art will recognize that the chimney 37 may have any desired form to suit one's preferences. Usually the chimney 37 is made taller than the tubular members comprising the candle lamp itself so that currents of air do not affect the flame at the top of the candle lamp. The chimney 37 may rest conveniently on the top surface 15.

From the foregoing description of one embodiment of the invention, those skilled in the art will recognize many features and advantages among which the following are particularly significant:

That the candle lamp is an exact aesthetic representation of a wax candle for use in restaurants, lounges and the like with none of the disadvantages from using wax candles or other types of oil lamps;

That the candle lamp is simple in construction and design whereby such candle lamps are relatively inexpensive; and That the candle lamp vaporizes combustible fuel which is consumed rather than the wick, producing a large beautiful steady flame; such a candle lamp consuming only one ounce of fuel during a period of six hours burning time making the candle lamp a fraction of the cost of a comparable wax candle.

Although the present invention has been described herein with a certain degree of particularity, it is understood that the present disclosure has been made only as an example and that the scope of the present invention is defined by what is herein after claimed.

What is claimed is:

1. A fuel burning candle lamp comprising:

a. a reservoir base holding combustible fuel and having an air vent communicating with the ambient;

b. a first tubular member supported vertically on said base, said first tubular member being shaped like a conventional wax candle;

c. a second tubular member supported on said base in concentric spaced apart relation within said first tubular member;

d. an adapter removably fitted on the second tubular member and having an axial bore therethrough; and e. a wick extending upward from said reservoir base through said second tubular member and through said adapter, said wick being flat and folded and forming three fuel-vaporizing channels between the wall of said bore and the peripheral surface of said wick.

* * * * *